33-241 SR
6/21/77 OR 4,030,203

United States Patent [19]
Ackerman, Jr.
[11] 4,030,203
[45] June 21, 1977

[54] REFLEX SIGHT RETICLE ILLUMINATOR

[75] Inventor: William R. Ackerman, Jr., El Paso, Tex.

[73] Assignee: Olin Corporation, New Haven, Conn.

[22] Filed: Oct. 4, 1974

[21] Appl. No.: 512,832

[52] U.S. Cl. ..... 33/241; 250/467
[51] Int. Cl.[2] ..... F41G 1/32; F21K 2/00
[58] Field of Search ..... 33/241, 297; 240/2 M, 240/2.25; 250/467; 356/251; 350/65, 67

[56] References Cited

UNITED STATES PATENTS

| | | | |
|---|---|---|---|
| 802,277 | 10/1905 | Fric | 33/241 |
| 2,171,571 | 9/1939 | Karnes | 33/241 |
| 2,392,979 | 1/1946 | Douden | 250/467 |
| 2,706,335 | 5/1957 | Munsey | 33/241 |
| 3,098,303 | 7/1963 | Plisk | 33/241 |
| 3,121,163 | 2/1964 | Rickert | 33/241 |
| 3,205,351 | 9/1965 | Walker | 350/67 |
| 3,320,671 | 5/1967 | Rickert et al. | 33/241 |
| 3,740,981 | 6/1973 | Patriquin | 350/65 |

*Primary Examiner*—Richard E. Aegerter
*Assistant Examiner*—Richard R. Stearns
*Attorney, Agent, or Firm*—William W. Jones; Donald R. Motsko

[57] ABSTRACT

A reticle illuminator for a reflex sight having a light gathering rod mounted in a housing which in turn is mounted on the sight barrel or housing. The rod is exposed to ambient light and emits fluorescent light to illuminate the reticle. A magnifying lens is focussed on the rod to intensify the brightness of the ambient light which strikes the rod. The rod housing has a number of component parts for easy assembly and disassembly.

3 Claims, 4 Drawing Figures

REFLEX SIGHT RETICLE ILLUMINATOR

This invention relates to reflex type sights in general, and more particularly to reticle illuminators for such sights which illuminators operate with ambient incident light.

Optical sights which utilize a light-gathering member of fluorescent light-transmitting material are known to the prior art. These sights use the fluorescent member to illuminate a reticle with a brightly colored light emitted by the member. The member may itself be illuminated by an artificial light source or by ambient light. The light from the light source strikes the member and is absorbed thereby and converted to fluroescent light, which is transmitted internally be the member to the reticle.

One problem encountered by this type of sight involves the brightness of the ultimate light which energizes the fluorescent illuminator. Sights which use ambient incident light to energize the illuminator are fine under bright ambient conditions, but their utility diminishes with lessening of the ambient light brightness, such as is present at dawn, dusk, or on overcast days. It has been suggested that when ambient light proves to be insufficient for purposes of energizing the illuminator, artificial light sources, such as battery energized bulbs, luminescent materials, or the like, can be used to heighten the amount of light used to energize the illuminator. The use of such artificial light sources is, however, costly and bulky, and is undesirable when one wishes to produce an efficient, compact and inexpensive reflex sight.

Another problem encountered by reflex sights of the type described above concerns the mounting of the fluorescent illuminator. Preferably the illuminator should be easily mounted on the sighting device and protected from the surrounding environment, while at the same time exposed to the energizing light source. The illuminator should be encased in its own housing, which should easily assembled and fitted onto the sighting device.

The illuminator device of this invention includes a fluorescent rod which absorbs ambient incident light, fluoresces the absorbed light and transmits the fluoresced light to one of its end walls where the fluoresced light is emitted to illuminate a reticle. The fluorescent rod is contained in its own housing which is easily assembled and mounted on the sight barrel. A portion of the housing comprises a lens which is focussed on the fluorescent rod and which transmits ambient light to the fluorescent rod. The lens concentrates the ambient incident light transmitted to the fluorescent rod and thus increases the illuminating capacity of the rod under any given set of ambient light conditions.

The illuminator housing includes a number of components which combine to encase the fluorescent rod and which snap onto the sight barrel when assembled. The components snap together to form the assembled housing.

It is, therefore, an object of this invention to provide a sighting device of the type having a fluorescent illuminator energized by ambient incident light, whicl illuminator is used to illuminate a reticle.

It is a further object of this invention to provide an illuminator of the character described wherein a fluorescent rod is used to fluoresce ambient incident light, and the rod is encased in a housing secured to the sight.

It is yet another object of this invention to provide an illuminator of the character described having a lens focussed on the rod to intensify ambient light transmitted to the rod to increase the illuminating ability of the light under any given ambient conditions.

It is an additional object of this invention to provide an illuminator of the character described wherein the illuminator housing includes a plurality of components which may be snapped together and snapped onto the sight housing for ease of manufacture and assembly.

These and other objects and advantages of the reticle illuminator of this invention will become more readily apparent from the following detailed description of a preferred embodiment of the invention taken in conjunction with the accompanying drawings, in which.

Figure 1:
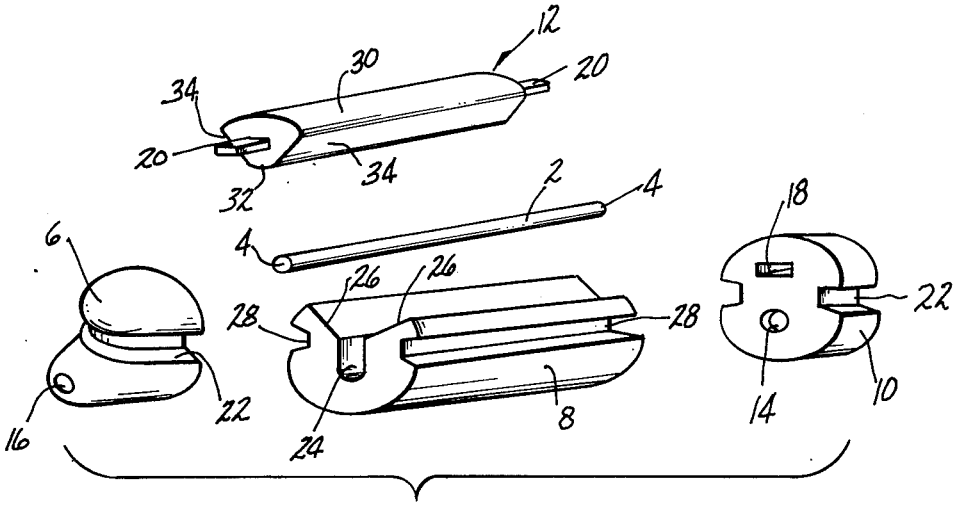
FIG. 1 is an exploded perspective view of one embodiment of a reticle illuminator assembly formed in accordance with this invention.

Referring now to the drawings, FIG. 1 shows the various components of the illuminator and its housing. The illuminator includes a fluorescent rod 2 of known qualities which receives ambient light through its side wall, fluoresces the ambient light, and pipes the fluoresced light internally to its end walls 4 where the fluoresced light is emitted. The housing includes several components, a front end cap 6, a lower middle part 8, a rear end cap 10, and a top cover 12. The rod 2 is formed from fluorescent plastic material, the end caps 6 and 10, and the middle part 8 are preferably formed from resilient ABS plastic, and the top cover 12 is preferably formed from clear "Lexan" plastic.

The front and rear caps 6 and 10 include a lower cylindrical recess 14 which receives the ends of the fluorescent rod 2. The recess 14 in the rear end cap is blind, but the recess 14 in the fron end cap 6 communicates with a bore 16 of reduced diameter which bore 16 forms the reticle or aiming point of the sight with which the reticle illuminator is used. Each end cap 6 and 10 is also formed with an upper rectangular recess 18 which receives projecting tabs 20 formed on the ends of the top cover 12. A groove 22 is formed in the exterior side wall of the end caps 6 and 10.

The middle part 8 includes an internal trough 24 in which the rod 2 is positioned, the trough 24 opening upwardly into outwardly inclined inner side walls 26. The middle part 8 is thus generally U-shaped in cross-section and is relatively springy due to the material from which it is constructed and its cross-sectional configuration. The middle part also includes an exterior wall groove 28 on its opposite sides, which grooves 28 register with the end cap grooves 22 to form a continuous groove around the exterior of the housing.

The top cover 12 includes an upper convexly curved surface 30, a lower convexly curved surface 32, and downwardly and inwardly tapering side surfaces 34. As previously noted, the top cover 12 is formed preferably of clear Lexan plastic and the upper and lower surfaces 30 and 32 are radiused so that the top cover 12 is in fact a cylindrical magnifying lens which, when the device is assembled, is focussed on the fluorescent rod 2 so as to magnify and intensify ambient light transmitted to the rod.

The reticle illuminator of this invention may be used with a variety of specific reflex sights, and the specific embodiment disclosed is particularly designed for use with a sight of the type disclosed in application for U.S. Pat. Ser. No. 270,356, William F. Steck, III, filed July 10, 1972 for illumination of one of the reticle indicia.

Figure 2:
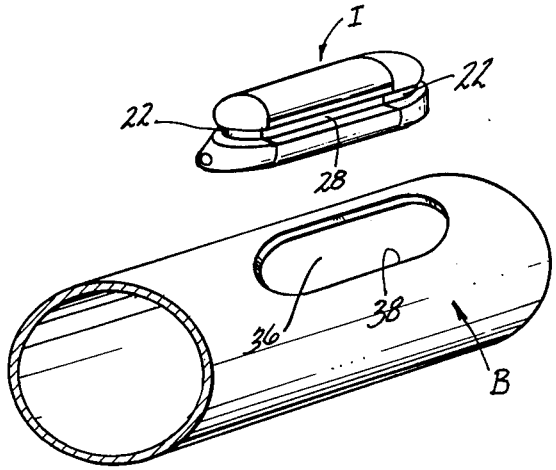
FIG. 2 is an exploded perspective view of the reticle illuminator assembly of FIG. 1 and a sight barrel on which the illuminator assembly may be mounted.
Figure 4:
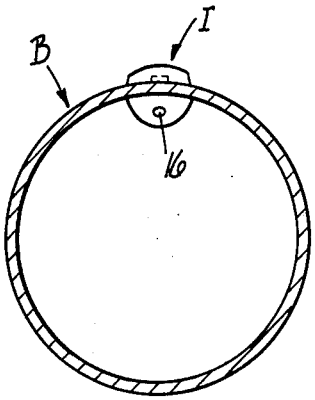
FIG. 4 is a vertical sectional view of the illuminator and sight barrel combination taken along line 4—4 of FIG. 3.

FIG. 2 shows the illuminator device I assembled ready for affixation to the barrel B of a sighting device of thereflex variety, and particularly of the type disclosed in the above-identified application. The sight barrel B has formed therein a longitudinally elongated opening 36 which is dimensioned so as to receive the illuminator device I with the sides 38 of the opening 36 being snap fitted into the groove 22, 28 extending about the side wall of the device I.

Figure 3:
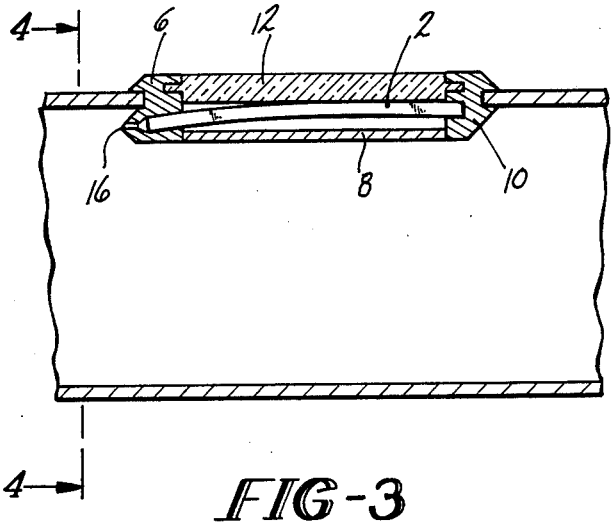
FIG. 3 is fragmentary longitudinal vertical sectional view of the reticle illuminator shown mounted on the sight barrel.

The illuminating device is assembled and secured to the sight barrel B as follows. The fluorescent rod 2 is inserted into the cylindrical recess 14 in the front end cap 6 of the housing and also laid into the trough 24 in the middle part 8 of the housing. The top cover-lens 12 is then positioned so that its forward tab 20 is inserted into the rectangular recess 18 formed in the front end cap 6. The partially assembled device is then inserted into the opening 36 in the sight barrel B with the middle part 8 of the housing being laterally squeezed to permit insertion of the opening side walls 38 into the groove 28. The rear end cap 10 is then positioned behind the middle part so that the rear end part of the rod 2 enters the blind cylindrical opening 14 in the rear end cap 10 and the rear tab 20 on the top cover-lens enters the rectangular opening 18 in the rear end cap. The rear end cap is then pressed downwardly until the side wall 38 of the opening 36 snaps into the groove 22 on the rear end cap. FIG. 3 shows the illuminator device as it appears mounted on the sight barrel. The tabs 20 and mating rectangular openings 18 coact to pull the top cover-lens 12 tightly down onto the middle part 8 of the housing which in turn causes the inwardly tapering surfaces 34 on the top cover-lens to push downwardly on the outwardly tapering surfaces 26 on the middle part. Thus a wedging action is created which tends to force the grooves 28 tightly against the side walls 38 of the barrel opening 36 tending to seal the joint against transmittance of ambient incident light.

It will be readily appreciated that by providing a lens which is focussed on the fluorescent illuminator and which transmits ambient light to the illuminator to energize the latter, the amount of light emitted by the fluorescent illuminator will be increased because of the magnification or intensification of ambient light transmitted to the illuminator. It will be further appreciated that the housing assembly of this invention can be easily assembled and will be securely held in place on the sight without requiring any adhesives, fasteners, or the like.

Since many changes and variations of the disclosed embodiment of the invention may be made without departing from the inventive concept, it is not intended to limit the invention otherwise than as required by the appended claims.

What is claimed is:

1. A reticle illuminator for use with a sighting device, said illuminator comprising:

a. a housing comprising forward and rearward end caps and a middle portion intermediate said end caps, said end caps including first cylindrical recesses with the cylindrical recess in said forward end cap opening into a through bore which forms a reticle for the sighting device, said middle portion having a substantially U-shaped cross section with an internal trough and upwardly extending side walls terminating in upwardly and outwardly extending surfaces, said end caps and said middle portion having aligned external grooves extending to form a continuous groove around an external side surface of said housing;

b. a fluorescent rod mounted in said housing, said rod having its opposite end portions contained in said cylindrical recesses in said end caps; and c. a transparent cover member secured to said end caps and overlying said rod, said cover member having upwardly and outwardly extending side walls overlying said upwardly and outwardly extending surfaces on said side walls of said middle portion.

2. The illuminator of claim 1 wherein said end caps and cover member, include means operative to pull said cover member downwardly onto said middle portion and operative to bias said middle portion side walls outwardly by reason of engagement between said upwardly and outwardly extending side walls of said cover member and said upwardly and outwardly extending surfaces on said middle portion.

3. A sighting device comprising a sight housing having an opening formed in a side wall thereof, a reticle illuminator housing mounted in said opening, said illuminator housing having an external groove formed in a side wall thereof, side walls of said sight housing opening being disposed in said groove to retain said illuminator housing in place on said sight housing, said illuminator housing includes end caps, a middle portion, and a top cover, said end caps being provided with recesses and said top cover being provided with projections disposed in said recesses and thereby secured to said end caps, said top cover, said end caps and said middle portion being provided with cooperating means operable to bias side walls of said middle portion of said illuminator housing outwardly to produce a tightly sealed joint between said illuminator housing groove and said side walls of said sight housing opening.

* * * * *

UNITED STATES PATENT OFFICE

CERTIFICATE OF CORRECTION

Patent No. 4,030,203 Dated June 21, 1977

Inventor(s) William R. Ackerman, Jr.

It is certified that error appears in the above-identified patent and that said Letters Patent are hereby corrected as shown below:

Col. 1, line 41, after the word should --be-- should be inserted.

Col. 1, line 63, whicl should read ---which---.

Col. 2, line 44, fron should read ---front---.

Col. 3, line 12, thereflex should read ---the reflex---.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*